US011359522B2

(12) United States Patent
Cunningham et al.

(10) Patent No.: US 11,359,522 B2
(45) Date of Patent: Jun. 14, 2022

(54) OPTIMIZED TUBULAR STRUCTURE

(71) Applicant: GM Global Technology Operations LLC, Detroit, MI (US)

(72) Inventors: Andrew Thomas Cunningham, Royal Oak, MI (US); Andrea Boscolo, Turin (IT); Ali Shabbir, Ontario (CA); Zachary P. Steffes, West Bloomfield, MI (US); Michael P. Van De Velde, Shelby Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 241 days.

(21) Appl. No.: 16/450,306

(22) Filed: Jun. 24, 2019

(65) Prior Publication Data

US 2020/0400042 A1 Dec. 24, 2020

(51) Int. Cl.

*F01L 1/14* (2006.01)
*F01M 9/10* (2006.01)
*F01L 1/46* (2006.01)

(52) U.S. Cl.

CPC ..... *F01L 1/146* (2013.01); *F01M 9/104* (2013.01); *F01L 1/46* (2013.01); *F01L 2810/02* (2013.01)

(58) Field of Classification Search

CPC ..... F01L 1/146; F01L 1/46; F01L 2810/02; F01L 1/14; F01M 9/104
USPC ..... 123/90.35, 90.61–90.64
See application file for complete search history.

(56) References Cited

U.S. PATENT DOCUMENTS 2,434,080 A * 1/1948 Rosa ..... F01L 1/146 74/579 R
3,034,488 A * 5/1962 Reiners ..... F02M 57/021 123/276
5,662,075 A * 9/1997 Lyndhurst ..... F01L 1/14 123/90.48
5,720,246 A * 2/1998 Griffin ..... F01L 1/146 123/90.61
2004/0149244 A1* 8/2004 Diestelmeier ..... F01L 1/146 123/90.61
2005/0229886 A1* 10/2005 Sailer ..... F01L 1/24 123/90.55
2006/0130794 A1* 6/2006 Karbstein ..... F01L 1/24 123/90.48
2007/0151535 A1* 7/2007 Stevens ..... F01L 1/20 123/90.61

(Continued)

*Primary Examiner* — Devon C Kramer
*Assistant Examiner* — Kelsey L Stanek
(74) *Attorney, Agent, or Firm* — Vivacqua Crane, PLLC

(57) ABSTRACT

A tubular structure comprises a first end and a second end, a cylindrical outer structure, and at least one inner cavity defined by the cylindrical outer structure and the first and second ends. The first and second ends each include a recess and a cap press fit within the recess. The caps provide a connection point for the ends of the tubular structure. Each end includes a vent in fluid communication with the inner cavity during manufacturing of the tubular structure, prior to insertion of the caps. An isotropic internal support structure extends longitudinally between the ends within the cylindrical outer structure and defines an oil flow channel extending through the tubular structure, each cap includes a cap orifice aligned with the oil flow channel, and the cylindrical outer structure, the first and second ends, and the internal support structure are continuously and unitarily formed.

9 Claims, 2 Drawing Sheets

(56) References Cited

U.S. PATENT DOCUMENTS

2018/0216658 A1* 8/2018 Brown ..... F16C 7/023

* cited by examiner

OPTIMIZED TUBULAR STRUCTURE

INTRODUCTION

The present disclosure relates to a tubular structure that is designed to withstand offset linear and bending forces. More specifically, the present disclosure relates to a pushrod for an automobile that provides sufficient strength and stiffness to withstand linear and bending forces during operation of an engine within the automobile.

Conventionally manufactured tubular structures of this nature are turned on a lathe and have a gun-drilled oil passage to allow oil to flow through the tubular structure. The drilling creates a tube that leaves excess material inside local regions of the tubular structure. This excess material is necessary to meet minimum stiffness requirements, however, this excess material also adds mass to the tubular structure and inertia when the tubular structure is in motion.

A tubular structure has less mass, however, in many instances tubular structures are subject to off-axis loading creating bending forces that a tubular structure is not ideally suited to withstand.

Conventional manufacturing processes for tubular structures limit the feasibility of removing internal mass and creating an internal structure that increases the stiffness and resistance to bending forces. Stiffness and resistance to bending forces is a primary concern when designing valvetrains. Further, conventional tubular structures have limited opportunity to be tuned for specific applications, whereby mass can be minimized according to the structural requirements for specific applications.

Additive manufacturing techniques, such as laser powder bed fusion, provide the opportunity to create tubular structures that have internal support for stiffness and resistance to bending while leaving voids to reduce mass and inertia concerns. However, internal cavities of unfused powder add mass but little structure in additive manufactured parts. In addition, pockets of unfused powder can create a hazardous situation if the part breaks and the unfused powder is released during machining of the part or during use of the finished part.

Thus, while current tubular structures achieve their intended purpose, there is a need for a new and improved tubular structure that provides reduced mass and inertia while exhibiting sufficient stiffness and resistance to bending forces.

SUMMARY

According to several aspects of the present disclosure, a pushrod for an automobile comprises a first end and a second end, a cylindrical outer structure, and an isotropic internal support structure extending longitudinally between the first end and the second end within the cylindrical outer structure, the isotropic internal support structure defining an oil flow channel extending through the pushrod, wherein the cylindrical outer structure, the first and second ends, and the internal support structure are continuously and unitarily formed.

According to another aspect of the present disclosure, the first end and the second end each include an orifice, the oil flow channel extending between the orifice in the first end and the orifice in the second end.

According to another aspect of the present disclosure, the first and second ends each include a recess formed therein and a cap press fit within the recess, each cap adapted to provide a connection point for the first and second ends of the pushrod.

According to another aspect of the present disclosure, each cap includes a cap orifice aligned with the oil flow channel.

According to another aspect of the present disclosure, the pushrod further includes at least one inner cavity defined by the cylindrical outer structure, the internal support structure and the first and second ends.

According to another aspect of the present disclosure, the first end and the second end each include a vent in fluid communication with the at least one inner cavity, the vents being adapted to allow fluid communication with the at least one inner cavity during manufacturing of the pushrod, prior to insertion of the caps within the recesses formed at the first and second ends of the pushrod.

According to another aspect of the present disclosure, the internal support structure extends longitudinally between the first end and the second end in a helical pattern that defines an angle between the internal support structure and a longitudinal axis of the cylindrical outer structure that is no more than 45 degrees.

According to another aspect of the present disclosure, internal support structure includes a center shaft and a plurality of conical structures spaced longitudinally within the pushrod, each conical structure extending radially between the cylindrical outer structure and the center shaft and defining an angle between the internal support structure and a longitudinal axis of the cylindrical outer structure that is no more than 45 degrees.

According to another aspect of the present disclosure, each of the plurality of conical structures includes a first end where the conical structure extends from the center shaft and a second end where the conical structure extends from the cylindrical outer structure.

According to another aspect of the present disclosure, the plurality of conical structures are oriented such that the first ends of adjacent conical structures are adjacent to one another and second ends of adjacent conical structures are adjacent to one another.

According to another aspect of the present disclosure, the at least one inner cavity includes a plurality of inner cavities defined by the cylindrical outer structure, the internal support structure and the first and second ends.

According to another aspect of the present disclosure, the pushrod further includes a passageway extending through the internal support structure interconnecting the plurality of inner cavities, wherein the plurality of inner cavities are in fluid communication with each other.

According to another aspect of the present disclosure, the vents within the first end and the second end are in fluid communication with the passageway and the plurality of inner cavities.

According to another aspect of the present disclosure, the oil flow channel is formed within the center shaft.

According to several aspects of the present disclosure, a pushrod for an automobile comprises a first end and a second end, a cylindrical outer structure, and at least one inner cavity defined by the cylindrical outer structure and the first and second ends, wherein, each of the first and second ends includes a recess formed therein and a cap press fit within each recess, the caps adapted to provide a connection point for the first and second ends of the pushrod, further wherein, each of the first and second ends includes a vent formed therein for fluid communication with the at least one inner cavity during manufacturing of the pushrod, prior to insertion of the caps within the recesses formed at the first and second ends of the pushrod, and an isotropic internal support structure extending longitudinally between the first end and the second end within the cylindrical outer structure, the isotropic internal support structure defining an oil flow channel extending through the pushrod between an orifice in the first end and an orifice in the second end, wherein, each cap includes a cap orifice aligned with the oil flow channel, and the cylindrical outer structure, the first and second ends, and the internal support structure are continuously and unitarily formed.

According to another aspect of the present disclosure, the internal support structure extends longitudinally between the first end and the second end in a helical pattern that defines an angle between the internal support structure and a longitudinal axis of the cylindrical outer structure that is no more than 45 degrees.

According to another aspect of the present disclosure, the internal support structure includes a center shaft that defines the oil flow channel, and a plurality of conical structures spaced longitudinally within the pushrod, each conical structure extending radially between the cylindrical outer structure and the center shaft and defining an angle between the internal support structure and a longitudinal axis of the cylindrical outer structure that is no more than 45 degrees, each of the plurality of conical structures including a first end where the conical structure extends from the center shaft and a second end where the conical structure extends from the cylindrical outer structure, the plurality of conical structures being oriented such that the first ends of adjacent conical structures are adjacent to one another and second ends of adjacent conical structures are adjacent to one another, wherein, the at least one inner cavity includes a plurality of inner cavities defined by the cylindrical outer structure, the internal support structure and the first and second ends, the pushrod further including a passageway extending through the internal support structure interconnecting the plurality of inner cavities, wherein the plurality of inner cavities are in fluid communication with each other and the vents within the first end and the second end are in fluid communication with the passageway and the plurality of inner cavities.

According to several aspects of the present disclosure, a tubular structure comprises a first end and a second end, a cylindrical outer structure, and at least one inner cavity defined by the cylindrical outer structure and the first and second ends, wherein, each of the first and second ends includes a recess formed therein and a cap press fit within each recess, the caps adapted to provide a connection point for the first and second ends of the tubular structure, further wherein, each of the first and second ends includes a vent formed therein for fluid communication with the at least one inner cavity during manufacturing of the tubular structure, prior to insertion of the caps within the recesses formed at the first and second ends, and an isotropic internal support structure extending longitudinally between the first end and the second end within the cylindrical outer structure, the isotropic internal support structure defining an oil flow channel extending through the tubular structure between an orifice in the first end and an orifice in the second end, wherein, each cap includes a cap orifice aligned with the oil flow channel, and the cylindrical outer structure, the first and second ends, and the internal support structure are continuously and unitarily formed.

According to another aspect of the present disclosure, the internal support structure extends longitudinally between the first end and the second end in a helical pattern that defines an angle between the internal support structure and a longitudinal axis of the cylindrical outer structure that is no more than 45 degrees.

According to another aspect of the present disclosure, the internal support structure includes a center shaft that defines the oil flow channel, and a plurality of conical structures spaced longitudinally within the tubular structure, each conical structure extending radially between the cylindrical outer structure and the center shaft and defining an angle between the internal support structure and a longitudinal axis of the cylindrical outer structure that is no more than 45 degrees, each of the plurality of conical structures including a first end where the conical structure extends from the center shaft and a second end where the conical structure extends from the cylindrical outer structure, the plurality of conical structures being oriented such that the first ends of adjacent conical structures are adjacent to one another and second ends of adjacent conical structures are adjacent to one another, wherein, the at least one inner cavity includes a plurality of inner cavities defined by the cylindrical outer structure, the internal support structure and the first and second ends, the tubular structure further including a passageway extending through the internal support structure interconnecting the plurality of inner cavities, wherein the plurality of inner cavities are in fluid communication with each other and the vents within the first end and the second end are in fluid communication with the passageway and the plurality of inner cavities.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
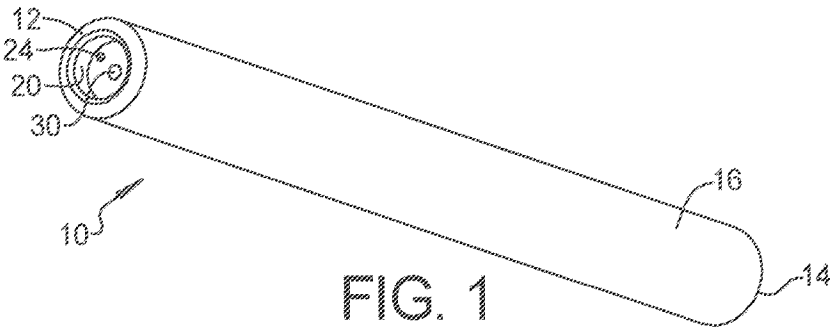
FIG. 1 is a perspective view of a tubular structure according to an exemplary embodiment without caps.

Referring to FIG. 1, a pushrod 10 assembly for an automobile is generally shown. It should be understood that the structure described herein may be applicable to tubular structures generically, and should not be limited to a pushrod assembly.

A pushrod 10 for an automobile engine in accordance with the present disclosure comprises a first end 12 and a second end 14, a cylindrical outer structure 16, and at least one inner cavity 18 defined by the cylindrical outer structure 16 and the first and second ends 12, 14. Each of the first and second ends 12, 14 includes a recess 20 formed therein. A cap 22 is press fit within each recess 20. The caps 22 are adapted to provide a connection point for the first and second ends 12, 14 of the pushrod 10. More specifically, the caps 22 are adapted to receive valve actuation motions from a valve actuation motion source at one end of the pushrod 10, and to impart the valve actuation motions to a valve train component at the opposite end of the pushrod 10.

Each of the first and second ends 12, 14 includes a vent 24 formed therein for fluid communication with the at least one inner cavity 18 during manufacturing of the pushrod 10, prior to insertion of the caps 22 within the recesses 20 formed at the first and second ends 12, 14 of the pushrod 10. The feasibility of manufacturing a tubular structure or pushrod 10 of the present disclosure depends on additive manufacturing. Additive manufacturing is the only way to achieve the complex internal structures described herein for a continuously and unitarily formed component.

Additive manufacturing processes, such as laser powder bed fusion, use powdered material and create the part layer by layer. Inner cavities 18 within the pushrod 10 will contain un-fused powder material. The vents 24 formed within the first and second ends 12, 14 allow the un-fused powder to be removed from the pushrod 10 prior to insertion of the caps 22 within the recesses 20. Once the powder is removed, the caps 22 are press fit within the recesses 20 at the first and second ends 12, 14 of the pushrod 10. Once in place, the caps 22 will block the vents 24 preventing contamination from entering the inner cavities 18 of the push rod 10.

An isotropic internal support structure 26 extends longitudinally between the first end 12 and the second end 14 within the cylindrical outer structure 16. The isotropic internal support structure 26 defines an oil flow channel 28 extending through the pushrod 10 between an orifice 30 in the first end 12 and an orifice 30 in the second end 14. Each cap 22 includes a cap orifice 32 aligned with the oil flow channel 28. The cap orifices 32 and the oil flow channel 28 allow oil to be transferred through the pushrod 10.

The cylindrical outer structure 16, the first and second ends 12, 14, and the isotropic internal support structure 26 are continuously and unitarily formed. As mentioned above, this is feasible for such applications by using additive manufacturing processes.

Figure 2:
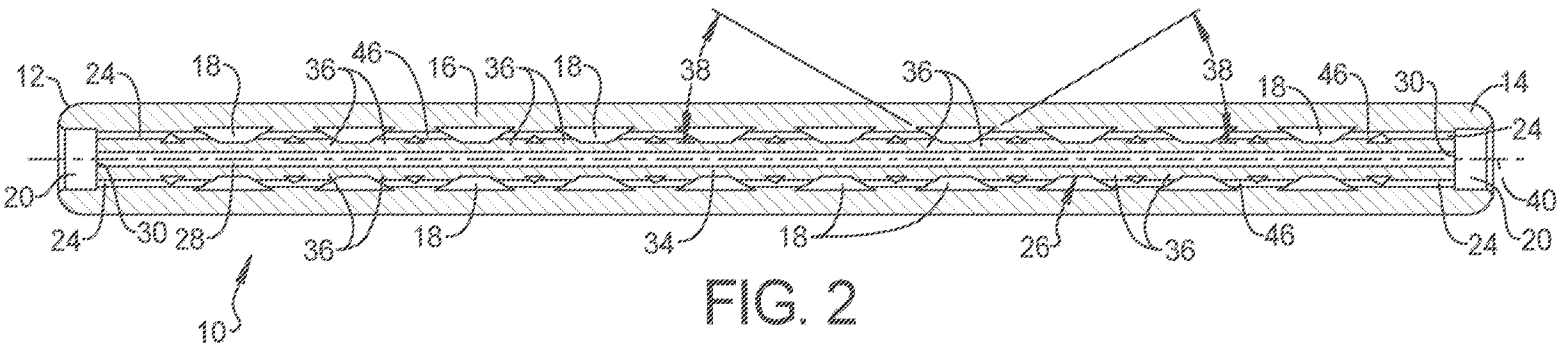
FIG. 2 is a sectional view of the tubular structure shown in FIG. 1.
Figure 3:
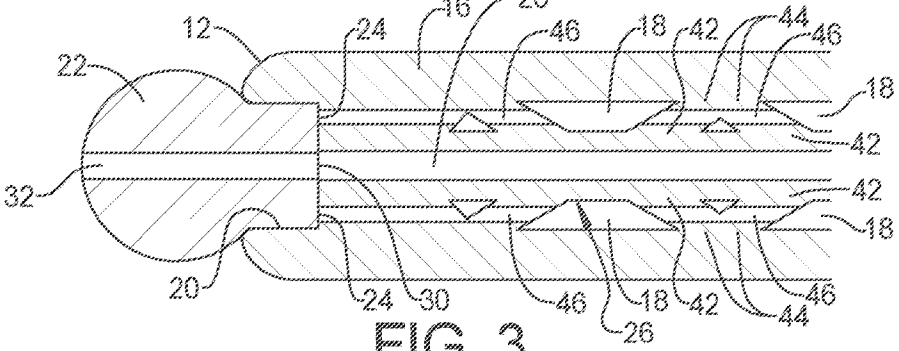
FIG. 3 is an enlarged sectional view of a portion of FIG. 2 with the cap in place.

Referring to FIG. 2 and FIG. 3, in an exemplary embodiment, the isotropic internal support structure 26 includes a center shaft 34 that defines the oil flow channel 28. A plurality of conical structures 36 are spaced longitudinally within the pushrod 10. Each conical structure 36 extends radially between the cylindrical outer structure 16 and the center shaft 34 and defines an angle 38 between the isotropic internal support structure 26 and a longitudinal axis 40 of the cylindrical outer structure 16 that is no more than 45 degrees.

Limitations of the additive manufacturing process require that the angle 38 between the conical structures 36 and the longitudinal axis 40 of the cylindrical outer structure 16 be no more than 45 degrees. During the additive manufacturing process, the pushrods 10 will be printed vertically. The powder within the pushrod 10 during manufacturing will not provide sufficient support to maintain the conical structures 36 during manufacturing. Keeping the angle 38 between the longitudinal axis 40 of the cylindrical outer structure 16 and the conical structures 36 less than 45 degrees ensures that the conical structures 36 will not collapse during manufacture.

Each of the plurality of conical structures 36 includes a first end 42 where the conical structure 36 extends from the center shaft 34 and a second end 44 where the conical structure 36 extends from the cylindrical outer structure 16. The plurality of conical structures 36 are oriented in an alternating pattern where the first ends 42 of adjacent conical structures 36 are adjacent to one another and the second ends 44 of adjacent conical structures 36 are adjacent to one another. This alternating pattern provides optimal stiffness and resistance to bending. Further, the conical structures 36 extend 360 degrees around the circumference of the center shaft 34, providing isotropic load carrying characteristics. This is particularly important, as the pushrod 10 may rotate when in operation within the engine of an automobile, so the bending and off-set loading conditions may be applied to the pushrod 10 from any direction or orientation.

In the exemplary embodiment of FIG. 2 and FIG. 3, the cylindrical outer structure 16, the isotropic internal support structure 26, including the conical structures 36, and the first and second ends 12, 14 define a plurality of inner cavities 18. A passageway 46 extends through the isotropic internal support structure 26 interconnecting the plurality of inner cavities 18. The plurality of inner cavities 18 are in fluid communication with each other. The vents 24 within the first end 12 and the second end 14 are in fluid communication with the passageway 46 and the plurality of inner cavities 18. During manufacture of the pushrod 10, un-fused powder from the additive manufacturing process can be removed from the plurality of inner cavities 18 through the passageway 46 and the vents 24 prior to insertion of the caps 22.

The spacing of the conical structures 36, the wall thickness of the conical structures 36, and the angle 38 of the conical structures 36 relative to the longitudinal axis 40 can be varied to tune the load carrying capacity and resistance to bending of the pushrod 10. This allows the pushrod 10 to be designed to specific performance criteria while minimizing mass and inertia characteristics.

Figure 5:
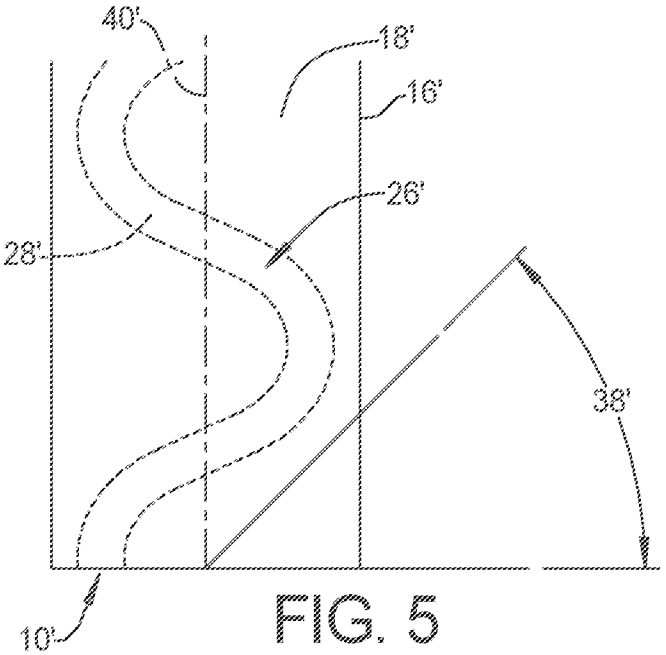
FIG. 5 is a side view of a portion of the tubular structure shown in FIG. 4.
Figure 4:
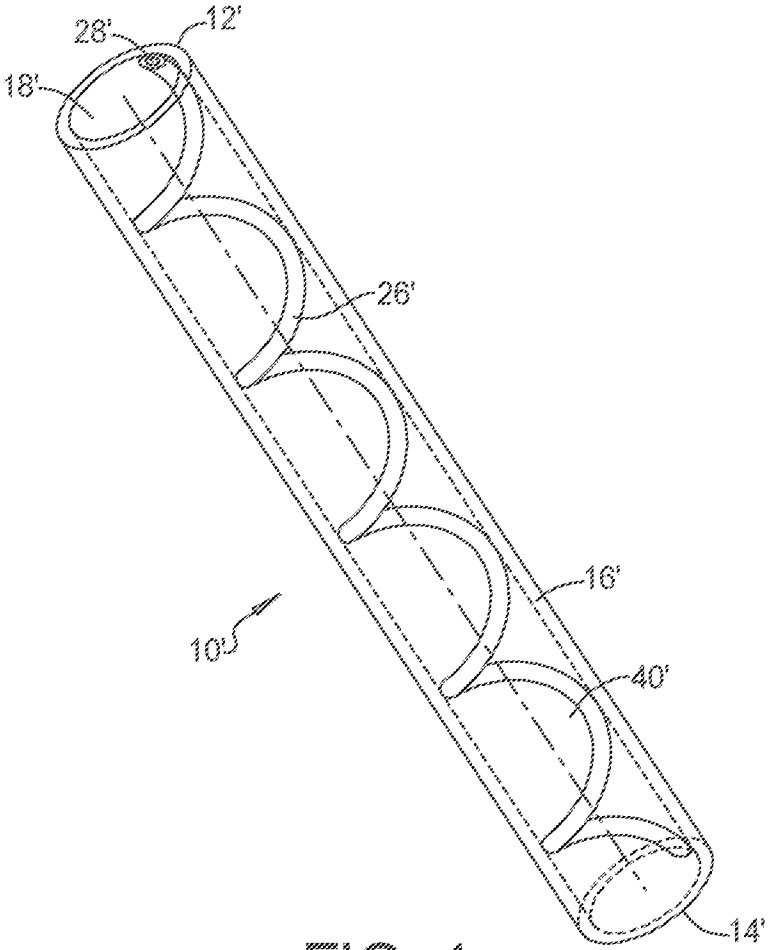
FIG. 4 is a perspective view of the cylindrical outer structure and the internal support structure for a tubular structure according to another exemplary embodiment.

Referring to FIG. 4 and FIG. 5, a pushrod 10' of another exemplary embodiment is shown. The pushrod 10' includes an isotropic internal support structure 26' extending longitudinally between a first end 12' and a second end 14' in a helical pattern. The isotropic internal support structure 26' has a tube shape that spirals longitudinally along an inner surface of a cylindrical outer structure 16' of the pushrod 10'. An oil flow channel 28' is defined by the tube-shaped isotropic internal support structure 26'.

The tube-shaped isotropic inner structure 26' takes up little of the volume within the pushrod 10', leaving a large inner cavity 18' within the pushrod 10'. Similar to the embodiment described above, during manufacture of the pushrod 10', un-fused powder from the additive manufacturing process can be removed from the inner cavity 18' through vents (not shown in FIG. 4 & FIG. 5) prior to insertion of caps (not shown in FIG. 4 & FIG. 5).

The helical pattern of the isotropic internal support structure 26' provides isotropic load carrying characteristics in the pushrod 10'. The helical shape of the isotropic internal support structure 26' defines an angle 38' between the isotropic internal support structure 26' and a longitudinal axis 40' of the cylindrical outer structure 16' that is no more than 45 degrees.

The spacing of the helical spiral, the angle 38' of the spiral, and the wall thickness of the isotropic internal support structure 26' can be varied to tune the load carrying capacity and resistance to bending of the pushrod 10'. This allows the pushrod 10' to be designed to specific performance criteria while minimizing mass and inertia characteristics. Additionally, the helical pattern of the isotropic internal support structure 26' may be adjusted to increase or decrease the length of the oil flow channel 28', or to impart more turbulence within the oil flow channel 28', to increase the cooling of oil that flows through the pushrod 10', thereby utilizing the pushrod 10' as a heat exchanger/oil cooler.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A pushrod for an automobile, comprising:

a first end and a second end;

a cylindrical outer structure; and an isotropic internal support structure extending longitudinally between the first end and the second end within the cylindrical outer structure, the isotropic internal support structure defining an oil flow channel extending through the pushrod and including a center shaft and a plurality of conical structures spaced longitudinally within the pushrod, each conical structure extending radially between the cylindrical outer structure and the center shaft and defining an angle between the internal support structure and a longitudinal axis of the cylindrical outer structure that is no more than 45 degrees;

wherein the cylindrical outer structure, the first and second ends, and the internal support structure are continuously and unitarily formed and define at least one inner cavity; and wherein the first end and the second end each include:

an orifice, the oil flow channel extending between the orifice in the first end and the orifice in the second end;

a recess formed therein and a cap press fit within the recess, each cap adapted to provide a connection point for the first and second ends of the pushrod and including a cap orifice aligned with the oil flow channel; and a vent in fluid communication with the at least one inner cavity, the vents being adapted to allow fluid communication with the at least one inner cavity during manufacturing of the pushrod, prior to insertion of the caps within the recesses formed at the first and second ends of the pushrod.

2. The pushrod of claim 1, wherein each of the plurality of conical structures includes a first end where the conical structure extends from the center shaft and a second end where the conical structure extends from the cylindrical outer structure.

3. The pushrod of claim 2, wherein the plurality of conical structures are oriented such that the first ends of adjacent conical structures are adjacent to one another and the second ends of adjacent conical structures are adjacent to one another.

4. The pushrod of claim 3, wherein the at least one inner cavity includes a plurality of inner cavities defined by the cylindrical outer structure, the internal support structure and the first and second ends.

5. The pushrod of claim 4, further including a passageway extending through the internal support structure interconnecting the plurality of inner cavities, wherein the plurality of inner cavities are in fluid communication with each other.

6. The pushrod of claim 5, wherein the vents within the first end and the second end are in fluid communication with the passageway and the plurality of inner cavities.

7. The pushrod of claim 1, wherein the oil flow channel is formed within the center shaft.

8. A pushrod for an automobile, comprising:

a first end and a second end;

a cylindrical outer structure;

wherein, each of the first and second ends includes a recess formed therein and a cap press fit within each recess, the caps adapted to provide a connection point for the first and second ends of the pushrod; and an isotropic internal support structure extending longitudinally between the first end and the second end within the cylindrical outer structure, the isotropic internal support structure defining an oil flow channel extending through the pushrod between an orifice in the first end and an orifice in the second end, and including a center shaft that defines the oil flow channel, and a plurality of conical structures spaced longitudinally within the pushrod, each conical structure extending radially between the cylindrical outer structure and the center shaft and defining an angle between the internal support structure and a longitudinal axis of the cylindrical outer structure that is no more than 45 degrees, each of the plurality of conical structures including a first end where the conical structure extends from the center shaft and a second end where the conical structure extends from the cylindrical outer structure, the plurality of conical structures being oriented such that the first ends of adjacent conical structures are adjacent to one another and the second ends of adjacent conical structures are adjacent to one another;

wherein, each cap includes a cap orifice aligned with the oil flow channel; and further wherein, the cylindrical outer structure, the first and second ends, and the internal support structure are continuously and unitarily formed and define a plurality of inner cavities defined by the cylindrical outer structure, the internal support structure and the first and second ends, the pushrod further including a passageway extending through the internal support structure interconnecting the plurality of inner cavities, each of the first and second ends including a vent formed therein, wherein, the plurality of inner cavities are in fluid communication with each other and the vents within the first end and the second end are in fluid communication with the passageway and the plurality of inner cavities, for fluid communication with the plurality of inner cavities during manufacturing of the pushrod, prior to insertion of the caps within the recesses formed at the first and second ends of the pushrod.

9. A tubular structure, comprising:

a first end and a second end;

a cylindrical outer structure;

wherein, each of the first and second ends includes a recess formed therein and a cap press fit within each recess, the caps adapted to provide a connection point for the first and second ends of the tubular structure; and an isotropic internal support structure extending longitudinally between the first end and the second end within the cylindrical outer structure, the isotropic internal support structure defining an oil flow channel extending through the tubular structure between an orifice in the first end and an orifice in the second end, and including a center shaft that defines the oil flow channel, and a plurality of conical structures spaced longitudinally within the pushrod, each conical structure extending radially between the cylindrical outer structure and the center shaft and defining an angle between the internal support structure and a longitudinal axis of the cylindrical outer structure that is no more than 45 degrees, each of the plurality of conical structures including a first end where the conical structure extends from the center shaft and a second end where the conical structure extends from the cylindrical outer structure, the plurality of conical structures being oriented such that the first ends of adjacent conical structures are adjacent to one another and the second ends of adjacent conical structures are adjacent to one another;

wherein, each cap includes a cap orifice aligned with the oil flow channel; and further wherein, the cylindrical outer structure, the first and second ends, and the internal support structure are continuously and unitarily formed and define a plurality of inner cavities defined by the cylindrical outer structure, the internal support structure and the first and second ends, the tubular structure further including a passageway extending through the internal support structure interconnecting the plurality of inner cavities, each of the first and second ends including a vent formed therein, wherein, the plurality of inner cavities are in fluid communication with each other and the vents within the first end and the second end are in fluid communication with the passageway and the plurality of inner cavities, for fluid communication with the plurality of inner cavities during manufacturing of the tubular structure, prior to insertion of the caps within the recesses formed at the first and second ends.

* * * * *